US005689853A

United States Patent [19]

Lemmer

[11] Patent Number: 5,689,853

[45] Date of Patent: Nov. 25, 1997

[54] CLOSURE MEMBER RESTRAINING DEVICE

[75] Inventor: Hermanus Johannes Richard Lemmer, Pretoria, South Africa

[73] Assignee: Vector Designs (Proprietary) Limited, Sandton, South Africa

[21] Appl. No.: 517,627

[22] Filed: Aug. 22, 1995

[51] Int. Cl.[6] ..... E05F 5/02

[52] U.S. Cl. ..... 16/82; 16/86 R; 292/1; 292/DIG. 19

[58] Field of Search ..... 16/82, 85, 86 R, 16/86 A, DIG. 17; 292/1, DIG. 19

[56] References Cited

U.S. PATENT DOCUMENTS

| | | | |
|---|---|---|---|
| 89,819 | 8/1869 | Wagner | 292/DIG. 19 |
| 1,688,221 | 10/1928 | Abbey | 292/DIG. 19 |
| 2,451,848 | 10/1948 | Martin | 16/86 R |
| 2,452,461 | 10/1948 | Harris | 16/86 A |
| 4,159,837 | 7/1979 | Morita | 292/DIG. 19 |
| 4,302,864 | 12/1981 | Morita . | |
| 5,226,201 | 7/1993 | Lefebvre | 16/82 |

FOREIGN PATENT DOCUMENTS

| | | | |
|---|---|---|---|
| 611868A1 | 8/1994 | European Pat. Off. | 16/86 A |
| 219278 | 9/1989 | Japan | 16/82 |
| 75/7715 | 10/1976 | South Africa . | |
| 79/02024 | 9/1980 | Sweden . | |

*Primary Examiner*—Chuck Y. Mah
*Attorney, Agent, or Firm*—Burns, Doane, Swecker & Mathis, L.L.P.

[57] ABSTRACT

A closure member restraining device 10 is provided which comprises a body mountable on a support surface, such as a wall, adjacent the closure member, a buffer arm 14 and a catch 16. The body comprises a buffer housing with a tubular sidewall 20 and an integrally moulded skirt 22 extending backwardly from the housing. The catch 16 depends from the buffer housing and automatically engages a handle formation on an opened door and restrains the door, so preventing it from closing. The buffer arm 14 is movable into and out of the buffer housing by coaxial screw or sliding movement to pre-set its position so that irrespective of the distance between the handle formation and the closure member, the buffer arm 14 abuts the closure member when the handle formation is engaged by the catch, thereby preventing movement of the closure member.

21 Claims, 4 Drawing Sheets

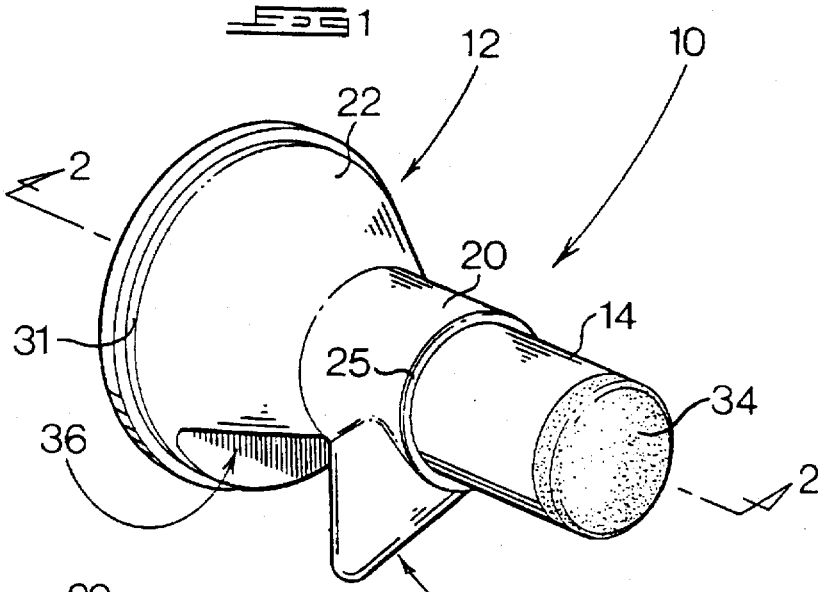
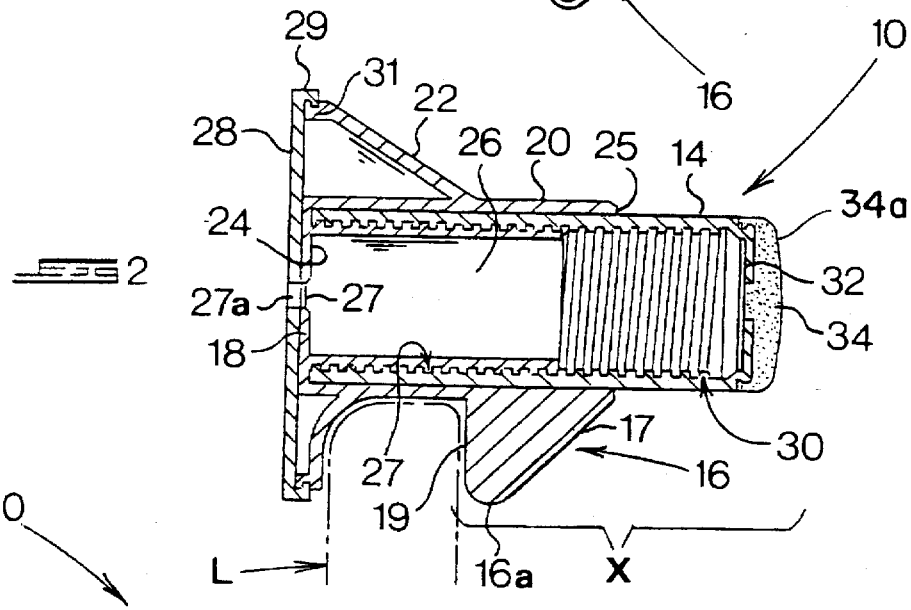
2
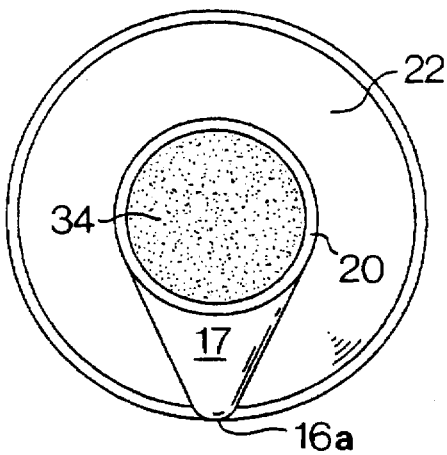
3
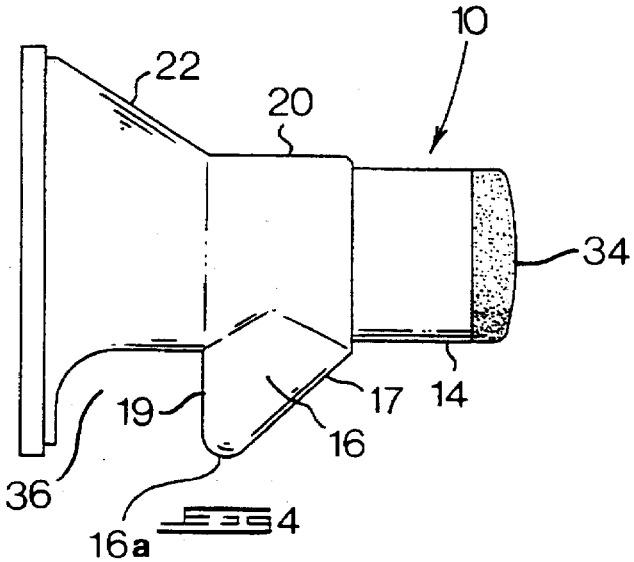
4

CLOSURE MEMBER RESTRAINING DEVICE

BACKGROUND OF THE INVENTION

The invention relates to a restraining device which keeps a closure member, such as a door, in an open position.

Existing restraining devices of this kind have various drawbacks. For example, a retaining device for keeping a door or like closure member equipped with a lever-type handle in an open position is described in South African Patent No 75/7715. This device has a hook-shaped catch which is mountable on a wall adjacent the door and which engages the handle of the door when the door is opened fully, thereby retaining the door in the open position. However, the device cannot be adjusted to suit different handles and doors.

Another device for retaining a door in an open position is described in Swedish Patent No 7902024-4. This device comprises a spring loaded bumper, which acts as a door stop, and a catch which is pivotally mounted alongside the bumper and which can be manually swung downwards into a position where it engages the handle of the door so that the handle is held between the bumper and the catch. To disengage the catch, it must again be swung manually away from the handle. The manual enagement and disengagement of the catch is awkward. Also, if the catch is inadvertently left in its downward position, extending beyond the bumper, it obstructs the bumper, thereby rendering it unable to cushion the impact of the door handle against the catch when the door is swung open again.

SUMMARY OF THE INVENTION

According to the invention a device for restraining a closure member having a handle formation thereon comprises:

- a body mountable on a support surface adjacent the closure member;
- a buffer extending from the body and serving to stop the closure member at a predetermined distance from the support surface when it is opened; and
- a catch engagable with a handle formation on the closure member, the buffer or the catch or both being movable to pre-set their relative positions to compensate for variations in the distance between the handle formation and the closure member, so that when the closure member is opened towards the support surface, the handle formation is engaged automatically by the catch and the buffer abuts the opened closure member.

The body preferably defines a buffer housing which within the buffer is movable.

The buffer housing is preferably a cylindrical housing with a tubular sidewall.

The buffer is preferably movable relative to the buffer housing by coaxial sliding or screw movement.

The buffer is preferably elongate, and may be a hollow arm at least part of which may be internally screw threaded, and the buffer housing may have a central, complementally externally screw threaded pillar extending therethrough over which the hollow buffer arm can be screwed to move it into and out of the buffer housing.

Alternatively, the buffer may be an elongate arm at least part of which may be externally screw threaded and the sidewall of the buffer housing may be complementally internally screw threaded so that the buffer arm can be screwed into and out of the buffer housing.

Instead, the sidewall of the buffer housing may be smooth, and the buffer arm is then slidable into and out of the buffer housing, with a fastener being provided to fix the buffer arm in place.

Further alternatively, the buffer may be fixed relative to the body and the catch my be movable relative to the buffer and to the body on a sleeve surrounding the buffer.

The body preferably defines a mounting base, at an opposed side thereof to the buffer housing, for mounting the device on the support surface.

Alternatively, or in conjunction with the above, the buffer may be biased, for example spring biased, away from the mounting base.

The catch is preferably located intermediate the mounting base and the buffer.

The handle formation my be a lever extending from a lever-type handle and which is biased into a rest positions in which case the catch is preferably fixed radially relative to the body and it preferably defines a first cam surface, which, on contact with the lever, urges the lever from its rest position, and a second restraining surface which retains the lever once it has ridden over the catch and returned to its rest position.

The handle formation may be a knob extending from a knob-type handle, in which case the catch is preferably movable radially relative to the body and it preferably defines a first cam surface which, on contact with the knob, moves radially towards the body from its rest position so that the lever riders over the catch, and a second, restraining surface which retains the knob once it has ridden over the catch and the catch has returned to its rest position.

The catch may be generally conical in shape and is preferably offset with respect to the longitudinal axis of the buffer so that the cam surface of the catch presents an oblique surface to the handle formation. Preferably, the restraining surface of the catch presents a substantially vertical surface to the handle formation so that the handle formation is both easily retained and easily disengaged from the catch by merely tuning the handle formation from its rest position and without having to manipulate the device itself.

The body is preferably also generally conical, tapering towards the buffer housing.

Preferably, at least a portion of the mounting base is planar and at least one aperture is preferably defined in the planar portion of the mounting base through which a fastener can be passed to mount the device on the support surface.

A first, exposed end of the buffer is preferably tipped with a resilient material to cushion the impact of an opened closure member against it.

The periphery of the mounting base is preferably also encased in a resilient material to cushion the impact of the device against the support surface on which it is mounted when a closure member impacts against the buffer.

BRIEF DESCRIPTION OF THE DRAWINGS

The invention will now be described in more detail, by way of example only, accompanying drawings in which:

FIG. 1 is a pictorial view of one embodiment of the closure member restraining device of the invention;

FIG. 2 is a sectional side view on 2—2 in FIG. 1;

FIG. 3 is a front view of the device of FIG. 1;

FIG. 4 is a side view of the device of FIG. 1;

DESCRIPTION OF PREFERRED EMBODIMENTS

Figure 5:
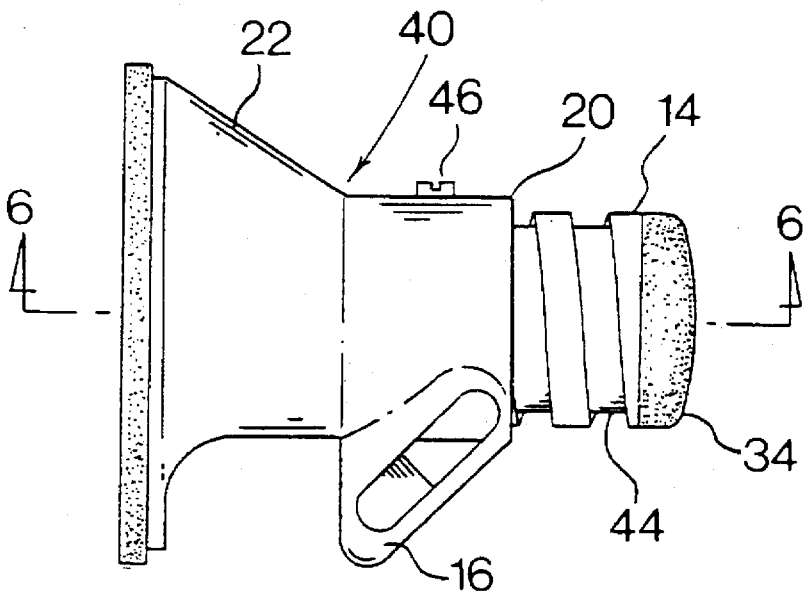
FIG. 5 is a side view of another embodiment of the closure member restraining device of the invention.

The closure member restraining devices, or "door stops", of the invention serve to stop closure members, such as doors, a pre-determined distance from an adjacent wall before the door slams into the wall. At the same time, a handle formation on the door is engaged automatically by a catch on the device to restrain the door from slamming shut again. This prevents damage to both the adjacent wall and to the door.

Some embodiments of the invention are intended for use with lever-type door handles which are biased into a rest position by an internal spring mechanism or the like. Other embodiments eater for knob-type handles or other fixed handles.

One embodiment of the closure member restraining device of the invention, referred to as the device 10, is illustrated in FIGS. 1 to 4. It has a moulded plastics body 12, a moulded plastics buffer 14 extending outwardly from the body 12 and an integrally moulded catch 16 extending downwardly from the body 12.

As can be seen in FIGS. 1 to 4, the body 12 defines a central, cylindrical buffer housing with a tubular sidewall 20, which is closed at one end 24, and open at the opposite end 25. The rear portion of the body comprises an integral conical skirt 22, which extends backwardly from approximately the middle of the sidewall 20 of the buffer housing and ends in a circular peripheral rim 31, so that the body has a planar, disc-shaped mounting base 18.

An integral central pillar 26, shown in FIG. 2, extends from the mounting base 18 into the buffer housing, coaxially therewith. The pillar 26 is externally screw threaded, as shown at 27.

The buffer 14 is a hollow, elongate arm that extends forwardly from the buffer housing. It is sized to fit snugly within the sidewall 20 of the buffer housing so that it does not rattle around within the buffer housing and yet is able to be moved into and out of the buffer housing with relative ease. It is internally screw threaded, as shown at 30 in FIG. 2, and its internally screw thread 30 is complemental with the external screw thread 27 of the pillar 26. Thus, the buffer arm 14 can be moved linearly by screwing it into and out of the buffer housing. This screw threaded arrangement ensures that the buffer arm 14 is held rigidly within the buffer housing and allows for reasonably free ajustment of the extent to which the buffer arm 14 extends from the buffer housing. This in turn determines the overall length of the device 10 and thus the distance from an adjacent wall at which an opened door is stopped.

The buffer arm 14, at its exposed forwardly end 32, is tipped with a cap 34 of resilient elastomeric material, such as rubber or plastic. This cap forms a forwardly facing stop surface 34*a* which cushions the impact of the opened door against the buffer arm 14 and prevents it from indenting or otherwise damaging the door. The cap 34 is either adhered or press fitted to the end 32 of the buffer arm 14. The whole buffer arm 14 may be made from the same or a similar resilient material of suitable stiffness.

The catch 16 is solid and is moulded integrally with the sidewall 20 of the buffer housing. It is offset with respect to the longitudinal axis of the buffer housing and when the device 10 is mounted in position, it extends downwardly from the buffer housing at a position intermediate the exposed end of the buffer arm 14 and the mounting base 18. Being integrally moulded and solid, it cannot move radially or axially relative to the buffer housing.

The shape of the catch, which may be described as generally conical, is important. It has a first, cam surface 17 which faces the handle of an opening door, and a second, opposed substantially vertical restraining surface 19 spaced inwardly from the stop surface 34*a*. The cam surface 17 is angled obliquely relative to the longitudinal axis of the buffer arm and away from an approaching handle, and thus the lever L of a lever-type handle (not shown) will ride against the cam surface and be depressed automtically, from its rest position, by the cam surface 17 as the door moves towards the device 10. Once the lever has ridden over the rounded bottom point 16*a* of the catch 16, it returns to its rest position under the urging of its own spring mechanism and is retained against the restraining surface 19 (see FIG. 2). By depressing the lever manually, it can be freed from the catch 16 and the door swung back into a closed position. Thus, the lever can be engaged and restrained by the catch 16 and then released from the catch 16 without the need to manipulate the device 10 itself at all. It is merely necessary to grasp the handle on the other side of the door and to turn it as though opening the door normally.

A recess 36 is formed in the skin 22 adjacent the restraining surface 19 of the catch 16. It is dimensioned to receive the lever, or other relevant part of the door handle, which is restrained behind the catch 16.

The distance X between the restraining surface 19 of the catch 16 and the tip 34 of the buffer arm 14 can be varied by screwing the buffer arm 14 into or out of the buffer housing depending on whether the distance X is to be decreased or increased. This allows for variations in the dimensions of different lever-type handles and ensures that once the lever of a particular door is engaged by the catch 16, the buffer arm 14 abuts the open door, irrespective of the distance between the lever and the face of the door. This substantially limits rattling of the lever within the recess 36 while ensuring that the buffer does not stop the door before the catch 16 has engaged the lever. In this way, a variety of different types of door handle can be catered for.

Although a locking screw or the like can be provided to lock the buffer arm in its preset position, the friction between the inner and outer surfaces of the arm and the corresponding portions of the body will normally be sufficient to prevent unwanted rotation of the arm, particularly when the screw thread thereon has a relatively shallow pitch.

An aperture 27 is formed centrally in the closed end 24 of the buffer housing. The device 10 is mounted against the relevant adjoining or adjacent wall by passing a screw or nail through this aperture 27 and into the adjoining wall. Access to this aperture 27 is gained by completely unscrewing the buffet arm 14 and by removing it from the buffer housing. It is returned once the mounting base 18 is attached to the adjoining wall and it conceals the screw.

A flat, resilient disc 28 made of rubber with a peripheral upstanding lip 29 is fitted to the rim 31 at the periphery of the skirt 22. The rubber disc 28 cushions the impact of the mounting base 18 and the rim 31 on the wall when an opened door impacts the buffer arm 14. An aperture 27*a* corresponding to the aperture 27 in the mounting base 18 is formed through the rubber disc 28 to allow the screw or nail to pass through.

Figure 6:
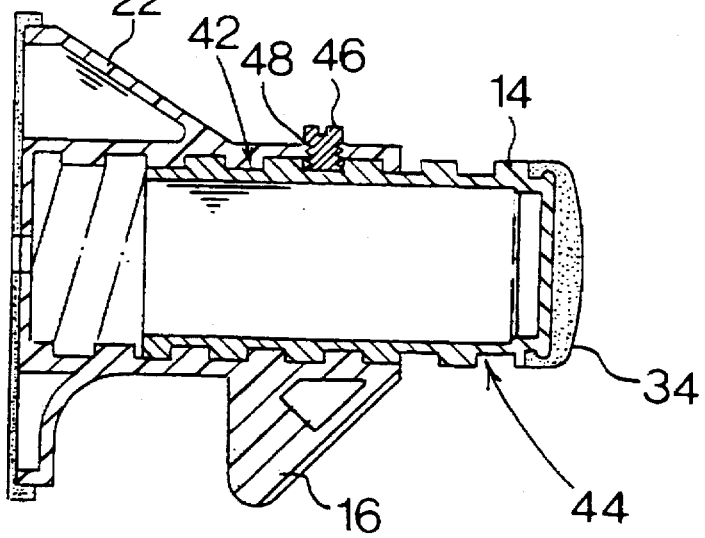
FIG. 6 is a sectional side view on 6—6 in FIG. 5.

Another embodiment of the device is shown in FIGS. 5 and 6. In this device, referred to as the device 40, there is no internal central pillar extending into the buffer housing. Instead, the sidewall 20 of the buffer housing itself is internally screw threaded at 42 and the buffer arm 14 is complementally externally screw threaded at 44 so that the buffer arm 14 can be screwed into and out of the buffer housing. A grub or locking screw 46 extends through an aperture 48 in the sidewall 20 of the buffer housing and it can be turned into the buffer housing to screw into or against the buffer arm 14 to assist in locking it in a pre-determined position within the buffer housing.

The only disadvantage of this version of the device is that the screw thread 44 is visible in use, which might be considered aesthetically undesirable.

Figure 7:
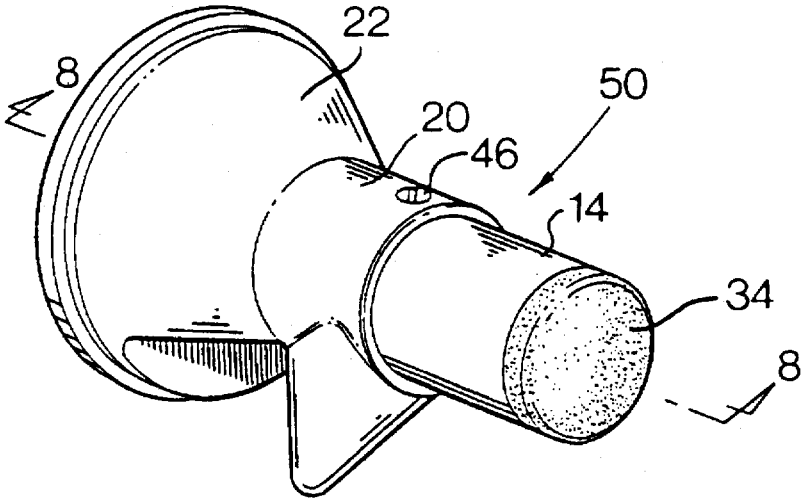
FIG. 7 is a pictorial view of yet another embodiment of the closure member restraining device of the invention.
Figure 8:
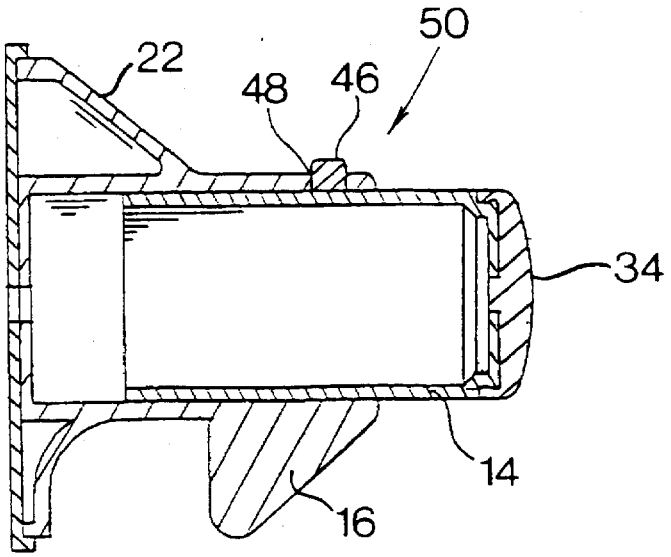
FIG. 8 is a sectional side view on 8—8 in FIG. 7.

Another embodiment of the device is shown in FIGS. 7 and 8. In this device, referred to as the device 50, there is also no central pillar extending into the buffer housing, nor are the buffer arm 14 and the sidewall 20 of the buffer housing threaded. Instead, the buffer arm 14 is merely slidable into and out of the buffer housing. It is held in a predetermined position by a grub screw 46, which passes through an aperture 48 defined in the sidewall 20 of the buffer housing, and which screws into or against the buffer arm 14. This type of device is suitable for use in conjuction with lighter doors, such as those made of hard board or similar material which will impact the buffer arm 14 with less force than for example a solid wooden door.

Figure 9:
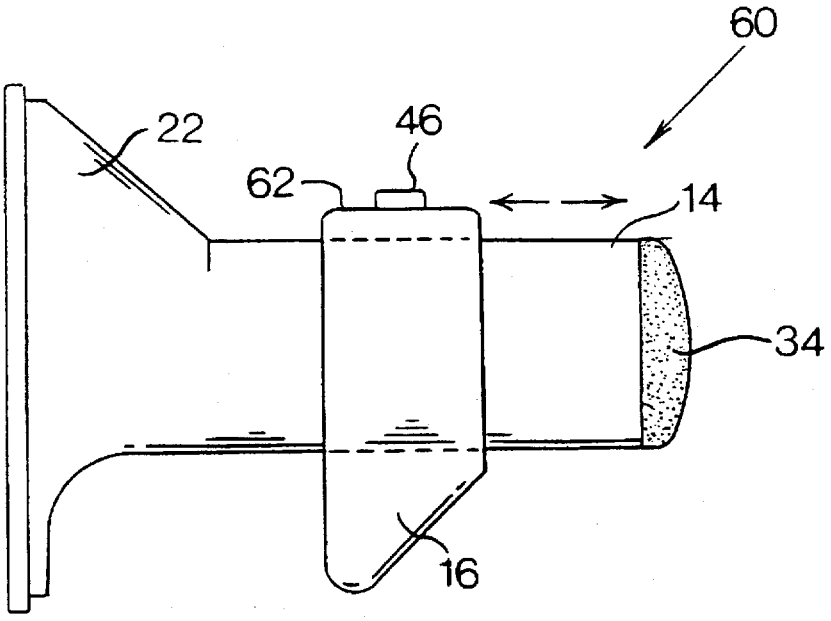
FIG. 9 is a side view of yet another embodiment of the closure member restraining device of the invention.

Another embodiment of the device, referred to as the device 60, is shown in FIG. 9. In the device 60, there is no buffer housing and the skirt 22 and buffer arm 14 are formed integrally. The buffer arm 14 is thus nonadjustable. The catch 16 is formed integrally with a sleeve 62 which is slidable coaxially along the buffer arm 14. A grub screw 46 passes through an aperture in the wall of the sleeve 62. Thus, when the screw 46 is screwed into or against the buffer arm 14, it fixes the sleeve 62 in a predetermined position on the buffer arm 14 and prevents both linear and rotational movement of the sleeve 62 about the buffer arm 14.

Figure 10:
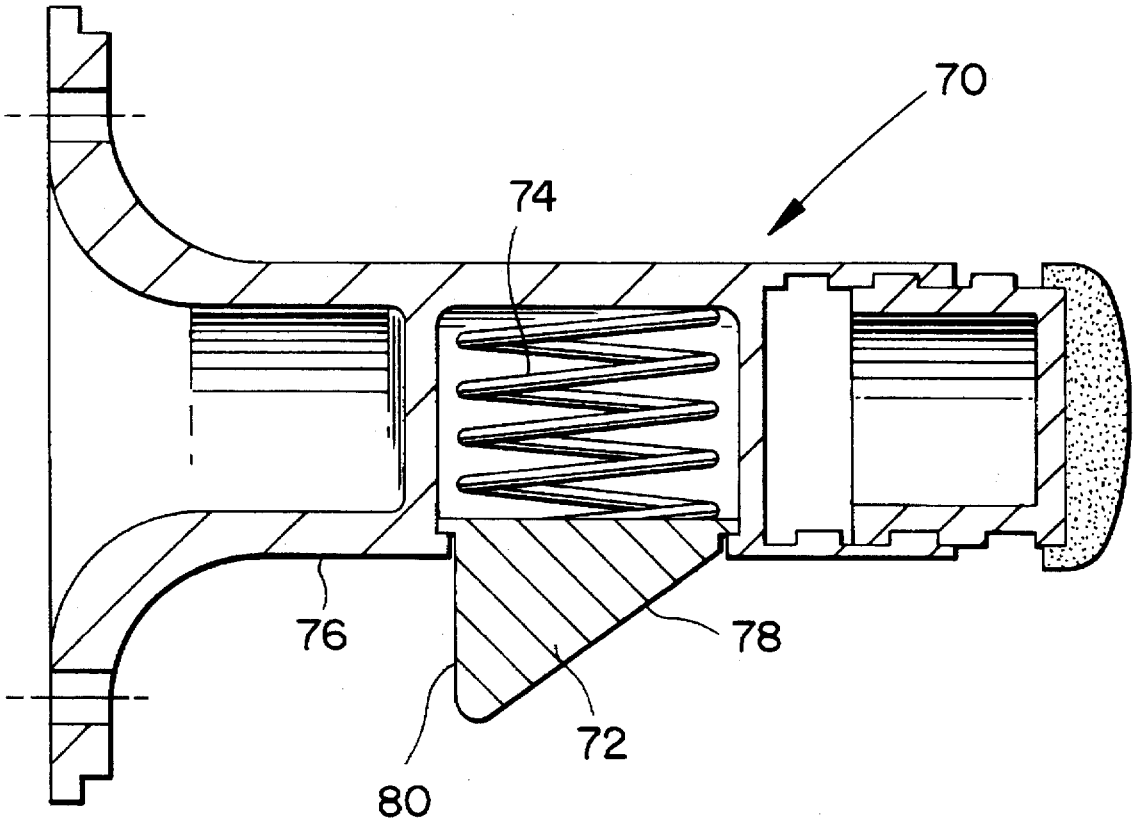
FIG. 10 is a side view of still another embodiment of the invention

In yet another embodiment of the invention, which illustrated in FIG. 10, the device 70 includes a catch 72 which is movable radially relative to the longitudinal axis of the device. The catch 72 is spring mounted, and is thus movable into a recess 74 defined in the sidewall 76 of the buffer housing The catch has an oblique cam surface 78 and a substantially vertical opposed restraining surface 80. This device is suitable for use with doors which have knob-type handles or other non-pivoting attached to them. As the knob-type handle of an opened door approaches the catch 72 and contacts the cam surface 78, the catch 72 will move into the recess and then return to its rest position once the knob has ridden over it. Instead of being spring mounted, the catch itself could be compressible, whereby its oblique cam surface would move radially toward the buffer as the catch is compressed by the knob.

The devices of the invention, being moulded from a tough plastics material, are cheap to manufacture. They are also light and can therefore be mounted easily onto a support surface. They can also be moulded in a variety of colours to blend in with the support surface.

The catch design ensures that, without any manipulation of the device, the door handle is engaged automatically as an opened door is swung against the device and there is no need to make a point of remembering to pivot or otherwise manipulate a catch behind the door so that it engages the handle to prevent the door from slamming.

I claim:

1. A closure restraining device for restraining a closure member having a handle formation thereon, the device comprising:

a body mountable on a support surface adjacent the closure member;

a buffer extending forwardly from the body and including a stop surface facing in a forward direction to stop the closure member at a predetermined distance from the support surface when it is opened; and a catch including a restraining surface engageable with a handle formation on the closure member, the restraining surface spaced rearwardly from the stop surface, the buffer and the catch being mounted for movement relative to one another to establish relative positions of adjustment between the catch and the stop surface to compensate for variations in the distance between the handle formation and the closure member, so that when the closure member is opened towards the support surface, the handle formation is engaged automatically by the catch and the buffer abuts the opened closure member, the buffer and catch being fixedly held in the respective relative positions.

2. A closure member restraining device according to claim 1, wherein the body defines a buffer housing within which the buffer is movable.

3. A closure member restraining device according to claim 1 which is adapted for use with a handle formation comprising a lever biased into a rest position relative to the closure member, and wherein the catch is fixed radially relative to the body and defines a first cam surface which, on contact with the lever, urges the lever from its rest position so that the lever rides over the catch, and a second restraining surface which retains the lever against travel away from the restraining device once the lever has ridden over the catch and returned to its rest position.

4. A closure member restraining device according to claim 3, wherein the first cam surface is obliquely angled relative to the longitudinal axis of the buffer.

5. A closure member restraining device according to claim 1 wherein the catch is movable radially relative to the body between an extended position and a restricted position and defines a first cam surface which, on contact with the handle formation, moves radially towards the body from the extended position towards the retracted position.

6. A closure member restraining device according to claim 5, wherein the first cam surface is obliquely angled relative to the longitudinal axis of the buffer.

7. A closure member restraining device according to claim 1, wherein the buffer is fixed relative to the body and the catch is movable relative to the buffer and to the body.

8. A closure member restraining device according to claim 7, wherein the catch is mounted on a sleeve which surrounds the buffer and which is movable coaxially along the buffer.

9. A closure member restraining device according to claim 1, wherein the catch extends transversely from the buffer.

10. A closure member restraining device according to claim 1, wherein a first, outer end of the buffer is tipped with a resilient material to cushion the impact of an opened closure member against it.

11. A device for restraining a closure member having a handle formation thereon, the device comprising:

a body mountable on a support surface adjacent the closure member and defining a housing;

a buffer movably mounted in the housing and extending therefrom and serving to stop the closure member at a predetermined distance from the support surface when it is opened; and a catch engageable with a handle formation on the closure member, the buffer and the catch being mounted for movement relative to one another to establish relative positions of adjustment between the catch and the stop surface to compensate for variations in the distance between the handle formation and the closure member, so that when the closure member is opened towards the support surface, the handle formation is engaged automatically by the catch and the buffer abuts the opened closure member.

12. A closure member restraining device according to claim 11, wherein the buffer housing is a cylindrical housing with a tubular sidewall.

13. A closure member restraining device according to claim 12, wherein the buffer is movable relative to the buffer housing by coaxial sliding or screw movement.

14. A closure member restraining device according to 13, wherein the buffer is an elongate, hollow arm, at least part of which is internally screw threaded, and the buffer housing has a central, complementally externally screw threaded pillar extending therethrough over which the hollow buffer arm can be screwed to move it into and out of the buffer housing.

15. A closure member restraining device according to claim 13, wherein the buffer is an elongate arm, at least part of which is externally screw threaded, and the sidewall of the buffer housing is complementally internally screw threaded so that the buffer arm can be screwed into and out of the buffer housing.

16. A closure member restraining device accorording to claim 13, wherein the sidewall of the buffer housing is smooth and the buffer arm is slidable into and out of the buffer housing.

17. A closure member restraining device according to claim 13, wherein a fastener extends through the sidewall of the buffer housing to fix the buffer arm in position within the buffer housing.

18. A closure member restraining device according to claim 11, wherein the body defines a mounting base, at an opposed side thereof to the buffer housing, for mounting the device on the support surface.

19. A closure member restraining device according to claim 18, wherein at least a portion of the mounting base is planar and at least one aperture is defined in the planar portion of the mounting base through which a fastener can be passed to mount the device on the support surface.

20. A closure member restraining device according to claim 18, wherein the catch is located intermediate the mounting base and the buffer.

21. A device for restraining a closure member having a handle formation thereon, the device comprising:

a body mountable on a support surface adjacent the closure member;

a buffer fixed to the body and extending therefrom and serving to stop the closure member at a predetermined distance from the support surface when it is opened;

a sleeve surrounding the buffer and movable coaxially therealong; and a catch affixed to the sleeve and engageable with a handle formation on the closure member, the buffer and the catch being mounted for movement relative to one another to establish relative positions of adjustment between the catch and the stop surface to compensate for variations in the distance between the handle formation and the closure member, so that when the closure member is opened towards the support surface, the handle formation is engaged automatically by the catch and the buffer abuts the opened closure member.

* * * * *